United States Patent [19]

Powers

[11] 4,026,592

[45] May 31, 9177

[54] ELECTROMAGNETIC LIFTING AND HANDLING DEVICE

[75] Inventor: Joseph T. Powers, Quaker Hill, Conn.

[73] Assignee: Morrison-Knudsen Company, Inc., New London, Conn.

[22] Filed: Nov. 14, 1975

[21] Appl. No.: 632,077

[52] U.S. Cl. ..... 294/65.5; 294/67 R; 214/114

[51] Int. Cl.[2] ..... B66C 1/04

[58] Field of Search ..... 294/65.5, 81 R, 81 SG, 294/67 R, 67 E, 67 ER, 67 DC, 67 DB; 214/8.5 D, 1 BT, 658, 114; 212/14, 81, 84, 89, 126, 127, 114; 254/144, 184

[56] References Cited

UNITED STATES PATENTS

| | | | |
|---|---|---|---|
| 916,374 | 3/1909 | Schnabel | 214/114 |
| 3,438,160 | 4/1969 | Gostling | 294/67 R |
| 3,601,440 | 8/1971 | Evans | 294/65.5 |
| 3,658,372 | 4/1972 | Madsen | 294/65.5 |

*Primary Examiner*—James B. Marbert
*Attorney, Agent, or Firm*—Shanley, O'Neil and Baker

[57] ABSTRACT

A device for lifting and positioning sheet steel piling of great length which eliminates permanent distortion of the piling during lifting and handling comprising an elongated openwork rigid structural member or framework having a plurality of electromagnets on its underside for picking up a sheet pile and moving it into vertical position contiguous to a pile already driven so that the two piles can be interconnected.

25 Claims, 7 Drawing Figures

ELECTROMAGNETIC LIFTING AND HANDLING DEVICE

BACKGROUND OF THE INVENTION

In the past great difficulty has been experienced in handling long sheet piling without the piling taking a permanent set while it is being lifted off the ground. The only solution to this difficulty has been to "whip" the piling into the air, i.e., lifting and dragging the piling sheet as rapidly as possible. This practice has nevertheless often resulted in piling taking a permanent set and in some cases has resulted in the dragged end of a pile being damaged. Since the dragged end of the pile is the end that has to be mated and interconnected with the previously driven piling, damage of the dragged end is especially objectionable.

By utilizing an elongated rigid but light-weight structural member, together with a plurality of spaced electromagnets, the present invention lifts a pile with no possibility of the sheet taking a set bend nor of one end of the pile being damaged since there is no dragging. The device also positions the pile properly for alignment and interconnection with the next adjacent pile which has already been driven into the ground. Since piling which presents these problems runs from 90 feet in length up to and over 110 feet, it will be apparent that the present invention solves a very real problem which has been present in the past.

SUMMARY OF THE INVENTION

A device for supporting a long flexible sheet metal pile while moving the pile from a horizontal storage position to an upright position for interlocking connection with an adjacent driven pile, comprising an elongated rigid, open framework of polygonal cross section formed of a plurality of longitudinal structural members extending the length of the framework and bracing members joined to the longitudinal structural members and extending transversely thereto, a plurality of electromagnetic means carried by the framework along the lowermost side of the framework, a pile engaging surface on each electromagnetic means facing downwardly, pivotal support means between each electromagnetic means and the framework for supporting the electromagnetic means with the pile engaging surface movable into surface engagement with the surface of a pile for optimum magnetic holding effect, the pivotal support means holding each electromagnet for limited movement around an axis parallel to the longitudinal axis of the framework and against appreciable rotational movement around a vertical axis through the center of the electromagnetic means, means disposed at points spaced along the length of the framework and carried by the upper members of the framework for attachment of lifting cables, and means carried by one end of the framework for suspending the framework and a pile held by the framework with the pile disposed as near as practicable to a desired upright position for movement into interlocking engagement with an adjacent driven pile.

DETAILED DESCRIPTION OF THE PREFERRED EMBODIMENT

Figure 1:
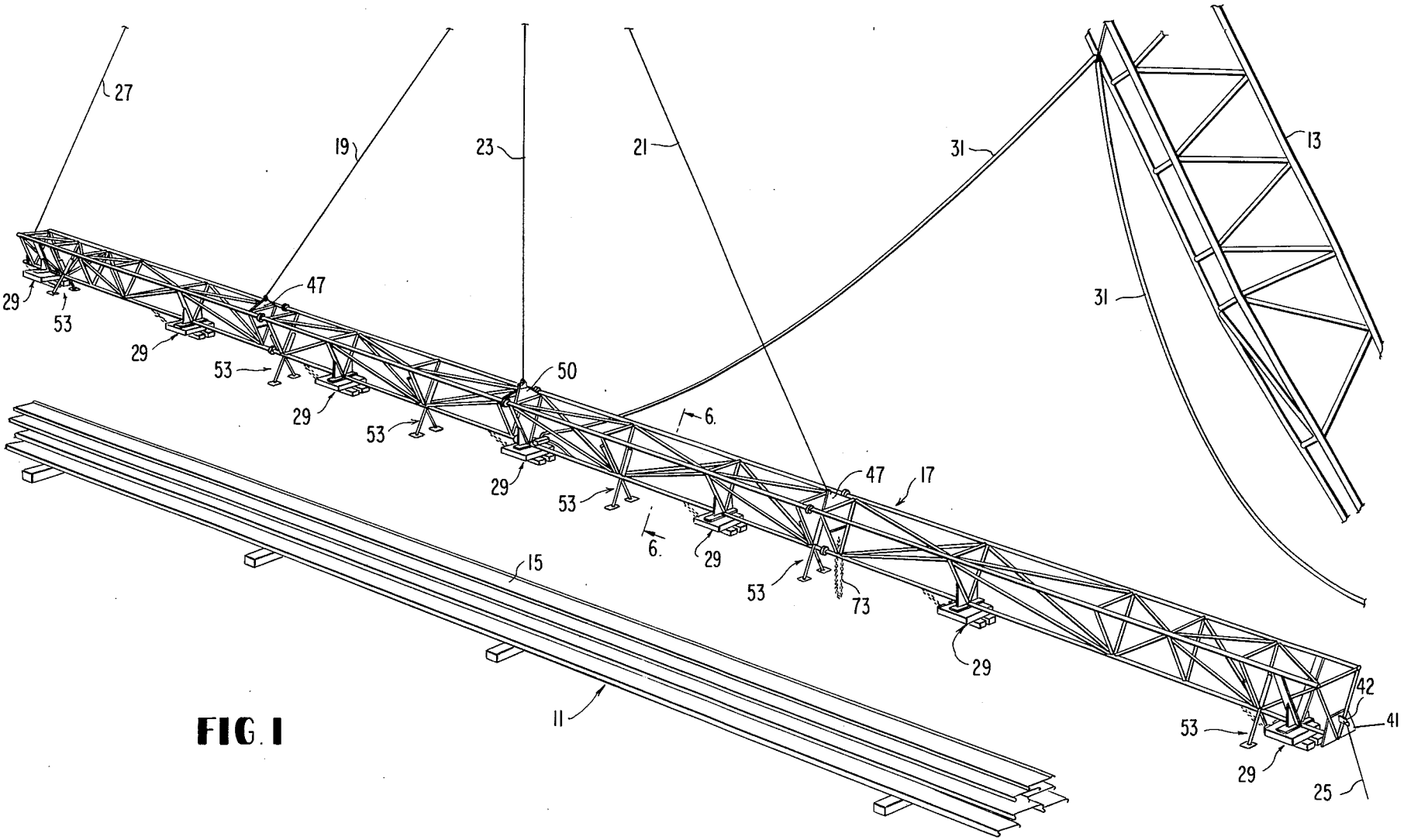
FIG. 1 is a perspective view of a preferred embodiment of the present invention and its environment of use.

Referring to FIG. 1, a stack of long sheet piling members, such members being hereinafter sometimes called piles or piling in the plural, and a pile in the singular, is shown at 11, these piling members customarily measuring 90 feet long and up. Also partially shown in FIG. 1 is the girder 13 of a crane used for lifting and handling a pile 15 from the stack 11. In this figure showing the preferred embodiment of the present invention, a very long openwork rigid structural member is indicated generally at 17. The structural member is lifted by the crane cables 19, 21 and 23 which make connection with the structural member through connection members to be described more in detail. A guiding line 25 maintains control of the structural member 17 while it is in the air and suspension cable 27 is eventually used to suspend the structural member and the pile the structural member is carrying in proper position for interconnection with an adjacent pile already driven into the ground, such interconnection and eventual driving of the pile being conventional practice.

Carried by the lower portion of framework 17 are a plurality of similar electromagnets indicated generally by the reference numeral 29. An electrical cable 31 carries electrical power to these magnets, which power can be turned on or off as needed in picking up or handling the piling and positioning the piling for driving into the ground. It will be understood that additional electrical cable 31, not fully illustrated in the drawing, connects all the electromagnets to the power source and power control.

Attention is now invited to FIGS. 2 to 5 which better show the details of construction of the framework 17 of the preferred embodiment of the present invention.

The framework 17 can be of any suitable construction which is light and rigid, preferably box girder construction. A framework of triangular cross sectional shape makes possible the suspension of the magnets in a manner farthest removed from the mass of the framework, whereby the mass of the framework interferes as little as practicable with the function of the magnets and lifting, handling and positioning the piling. Any light truss construction would be suitable, the preferred embodiment being made up of longitudinal pipe sections terminating in pipe flanges in order to make the device so it can be knocked down into four similar components, two pairs of connected components being shown separated in FIGS. 2 and 3. The cross bracing structural members in the preferred embodiment are also made up of pipe sections welded to the longitudinally extending structural members.

Figures 2, 3, 4, 5, 6, 7:
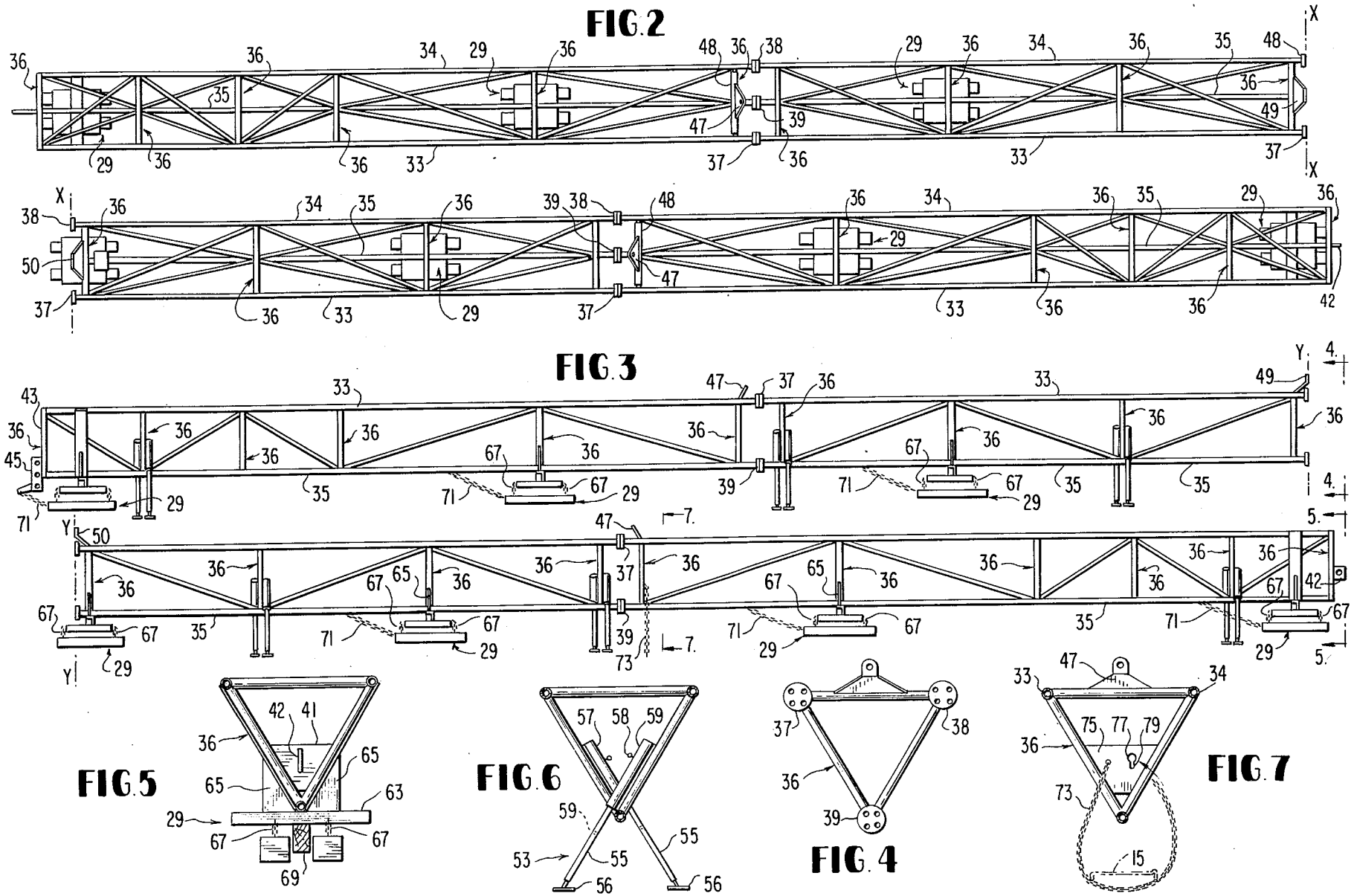
FIG. 2 is a plan view of the two sections making up the device which in use are connected together along the line x—x.
FIG. 3 is a side elevational view of the two sections making up the device which in use are connected together along the line Y—Y.
FIG. 4 is a view in section taken on the line 4—4 in FIG. 3.
FIG. 5 is a view in end elevation taken in the direction of the arrows 5—5 in FIG. 3.
FIG. 6 is a cross-sectional view taken on the line 6—6 of FIG. 1.
FIG. 7 is a view in section taken on the line 7—7 of FIG. 3.

Specifically, the first section shown on the left in FIG. 2 is made up of three similar longitudinal pipe sections 33, 34, 35, transversely braced by a plurality of bracing and trussing members including those indicated generally at 36 which are joined to longitudinal structural members 33, 34 and 35 and to each other to form the triangular cross-sectional shape of the framework. On the righthand ends of structural members 33, 34, 35 are pipe flanges 37, 38, 39, these pipe flanges being connected by bolts, not shown, to similar pipe flanges on the contiguous end of the righthand framework section shown in the lower portion of FIG. 2. Since the longitudinal structural members and the transverse bracing structural members of the righthand framework section shown in the lower portion of FIGS. 2 and 3 substantially correspond in shape and function to those of the lefthand section, the same reference numerals have been applied to the righthand framework section.

At the righthand end of the framework, as shown in FIGS. 2 and 3, the diaphragm bracing member 36 incorporates a solid plate member 41 which carries the perforated lug 42 to which guideline 25 can be attached. At the other end of the framework in similar manner plate member 43 carries a bracket 45 having a plurality of holes which are spaced vertically when the framework is on the ground in the position shown in FIG. 3. The purpose of these spaced holes will be more particularly described below.

It will be evident that the two sections of the framework shown in FIGS. 2 and 3 are interconnected as shown in FIG. 1 by bolts acting to hold pipe flanges 37, 38 and 39 together with section lines X—X and Y—Y coinciding.

As best shown in FIG. 1, the framework is lifted by crane cables 19 and 21 which are connected to similarly spaced connection lugs 47 similarly disposed on the end sections of the framework, each lug 47 being rotatably mounted by being welded to a tubular member 48 rotatably mounted on the uppermost pipe section of the corresponding diaphragm members 36 of the end sections. Cable 23 shown in FIG. 1 is connectable to a connection means made up of two cooperating parts 49 and 50, part 49 being rigidly welded to the innermost pipe section diaghragm 36 of the upper section of FIG. 2 and part 50 being rigidly welded to the top pipe section of diaphragm 36 at the righthand end of the lower section in FIG. 2. As shown in FIG. 1 when the two sections are both together part 48, 49 cooperate to form a cable connection at the center point of the framework. In some situations the cable 23 and composite lug 49, 50 would be suitable for lifting the framework while in other situations the two cables 19 and 21 are associated lugs 47 would be desirable.

As best shown in FIGS. 1 and 6, when the framework is on the ground it is supported on legs 53 spaced along its length so as to hold magnets 29 out of contact with the ground. As best shown in FIG. 6, each leg 53 comprises a pipe 55 carrying at its lower end a pad 56. The upper end of each pipe 55 is telescopically received in a tube 57 and a pin passing through the tube and a hole in the extreme end of the leg holds the leg against movement in the extended position. When the framework has been raised off the ground each leg 55 can be manually retracted into tube 57 after withdrawing pin 58 and a pin hole 59 in the leg will then receive pin 58 reinserted in tube 57 to hold the leg in retracted position.

Referring now specifically to the electromagnet means and its supporting structure, indicated generally at reference numeral 29, and considering especially FIGS. 2 to 5, a rectangular frame of angle irons 63 is supported on the underside of the framework by a gusset and angle iron arrangement 65 welded to the pipe sections forming certain of the diaphragm members of the framework (see FIG. 1). Each electromagnet is suspended at each end portion thereof by chain links 67 which hold each electromagnet against appreciable rotational movement around a vertical axis through the center of the electromagnet but permit the electromagnets to have limited movement fore and aft of the longitudinal dimenson of the framework and limited rotational movement around an axis parallel to the longitudinal axis of the framework, thus assuring a major magnet surface in the direction of the length of the piling and accommodating the electromagnets to any unevenness in the surface of the pile along the length thereof to assure a surface-to-surface contact between each electromagnet and the piling insofar as practicable. A block of wood 69 separates the two magnets and keeps them from being attracted into contact with each other.

When the framework lifts a pile by means of electromagnets, the electromagnets adapt themselves to the surface of the pile throughout its length and the pile is supported by chains 67 which in addition to the advantages of this mounting allow the pile and magnets to swing longitudinally of the framework to an objectional extent. In order to restrain this movement, chains 71 are provided connecting the end of each of the electromagnets which is nearest to the framework suspension bracket 45 to a fixed point on the lowermost longitudinal structural member 35 of the framework.

About half way along the framework (see FIG. 1), a safety chain 73 is permanently connected at one end to the pipe section of a diaphragm 36, the chain section being long enough so that its free end will extend under a pile held on the framework by the electromagnets and thence back up into the region of the framework to be there connected to a gusset plate 75 by the conventional chain connection of a round hole 77 having a slot 79 below it, the round hole passing all the links and the slot being dimensioned and disposed vertically to receive only a vertical link thereby fastening the chain at any desired link. This safety chain holds the pile in the event the pile gets loose from some of the electromagnets.

In operation, a stack of piling, derrick 13 and a pile driver, not shown, are disposed within working distance of one another. The piling in the stack can vary appreciably in length but usually runs between 90 feet and 110 feet or more. The gate of the steel forming the pile is such that lifting the pile from the stack at one end in order to suspend the pile for driving will cause the pile to bend and assume a permanent set. This is obviously objectionable in a pile which must be driven to great depths into the ground by a pile driver. Using the present invention, framework 17 has connected to its cables 19 and 21 and/or cable 23. At about the same time electrical power cable 31 is connected to the electromagnets so as to furnish electrical power to the magnets as controlled by a control means not shown. When not in use the framework 17 is resting on the ground or any suitable support surface on legs 53. At about this time suspension line 27 is connected to one of the holes in bracket 45 and guideline 25 is connected to the hole in lug 42. As the crane takes the weight of framework 17 off the legs 53, an operator pulls pins 58, manually retracts the legs into tubular members 57 and replaces pins 58 to hold the legs in retracted position. The framework is then positioned over a pile to be lifted and the framework lowered so as to bring the electromagnets into contact with the pile along the length of the same. Since the piles vary in length the end of the pile closest to the suspension bracket 45 end of framework is normally positioned close to this bracket. In some cases this means that the last one or two of the magnetic means at the other end of the framework may not be in engagement with the pile or in some cases the pile may extend past the end of the framework.

When the electrical power is turned on, the electromagnets adhere to the desired one of the piles 15 and the cables lift the framework and piling up with the piling in horizontal position. As the piling moves toward the point where it is to be driven into the ground, through the tension exerted on suspension line 27 and manipulation of the other supporting lines, the framework and pile approach the vertical position. When the framework and pile are located over the desired position for driving all of the weight of the framework and pile has been transferred to suspension line 27.

An important aspect of the present invention is that at the time the pile is to be interconnected with the contiguous pile already driven or partly driven into the ground, the pile carried by framework 17 must be as nearly as practicable vertical in order for the two piles to move easily and without binding into the interlocking position. In order to obtain this optimum result, experience dictates to the operator, before the pile is lifted, which of the holes in bracket 45 must receive suspension line 27, depending upon the length and therefore the weight of the pile to be handled, so as to bring the center of gravity of the combination of framework and pile as near as practicable under the suspension line attachment. Although bracket 45 with a plurality of spaced holes is disclosed for this purpose it will be obvious that any suitable means for controllably shifting the attachment point of suspension line 27 will accomplish the desired purpose.

When the pile and the framework are suspended over the spot where the pile is to be driven and interlocked with the next contiguous pile and the weight of the pile to be driven is borne by suspension cable 27, the pile is lowered into interconnected relationship with the contiguous driven pile and the function of framework 17 is completed. At this time the electrical control cuts off power to the electromagnets and the framework can be swung free of the ready-to-be-driven pile. The framework is then moved back to pick up another pile.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

I claim:

1. A device for supporting a long flexible sheet metal pile while moving the pile from a horizontal storage position to an upright position for interlocking connection with an adjacent driven pile, the device when considered as resting on the ground comprising a. an elongated rigid, open framework of polygonal cross section formed of a plurality of longitudinal structural members extending the length of the framework and bracing members joined to the longitudinal structural members and extending transversely thereto, b. a plurality of electromagnetic means carried by the framework along the lowermost side of the framework, c. a pile engaging surface on each electromagnetic means facing downwardly, d. pivotal support means between each electromagnetic means and the framework for supporting the electromagnetic means with the pile engaging surface movable into surface engagement with the surface of a pile for optimum magnetic holding effect, the pivotal support means holding each electromagnet for limited movement around an axis parallel to the longitudinal axis of the framework and against appreciable rotational movement in a plane normal to a vertical axis through the center of the electromagnetic means, e. means disposed at points spaced along the length of the framework and carried by the upper members of the framework for attachment of lifting cables, and f. means carried by one end of the framework for suspending the framework and a pile held by the framework with the pile disposed as near as practicable to a desired upright position for movement into interlocking engagement with an adjacent driven pile.

2. A device as claimed in claim 1 in which g. the framework is triangular in cross section with horizontal bracing members extending between two apices and the third apex is disposed below the other two, and h. the electromagnetic means is supported contiguous to and below the third apex.

3. A device as claimed in claim 1 in which g. the framework has a longitudinal, vertical plane of symmetry, h. means (f) is a bracket carried by one end of the framework and disposed in the longitudinal vertical plane of symmetry, and i. the bracket has a plurality of suspension cable connection means vertically spaced along the bracket, each cable connection means being located at a point such that when the framework is suspended supporting a pile, a cable connection means will be substantially directly over the center of gravity of the combined framework and pile structure, depending on the length of the pile.

4. A device as claimed in claim 1 in which g. means (e) comprise a pivoted connection means at each of two points along the length of the framework, each pivoted connection means being intermediate one end of the framework and the center of the framework, h. each pivoted connection means comprising a tubular member rotatably supported by and encasing a transversely extending horizontal bracing member.

5. A device as claimed in claim 1 including g. leg means arranged along the length of the framework and extending below the electromagnetic means when the framework is resting on the ground, and h. means associated with the leg means for retraction of the leg means above the electromagnetic means when the framework is suspended for lifting a pile.

6. A device as claimed in claim 5 in which i. means (h) includes tubular means which telescopically receives leg means (g).

7. A device as claimed in claim 6 in which j. the framework is triangular in cross section with two apices disposed in a horizontal plane and the third apex is disposed below the other two, and k. the tubular means and the associated leg means extend parallel to the lower sides of the triangle formed by the framework in cross section so that with the leg means extended, the sides of the triangle and the legs form an X.

8. A device as claimed in claim 1 including g. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

9. A device as claimed in claim 2 in which i. the framework has a longitudinal, vertical plane of symmetry, j. means (f) is a bracket carried by one end of the framework and disposed in the longitudinal vertical plane of symmetry, and k. the bracket has a plurality of suspension cable connection means vertically spaced along the bracket, each cable connection means being located at a point such that when the framework is suspended supporting a pile, a cable connection means will be substantially directly over the center of gravity of the combined framework and pile structure, depending on the length of the pile.

10. A device as claimed in claim 2 in which i. means (e) comprise a pivoted connection means at each of two points along the length of the framework, each pivoted connection means being intermediate one end of the framework and the center of the framework, j. each pivoted connection means comprising a tubular member rotatably supported by and encasing a transversely extending horizontal bracing member.

11. A device as claimed in claim 2 including i. leg means arranged along the length of the framework and extending below the electromagnetic means, and h. means associated with the leg means for retraction of the leg means above the electromagnetic means when the framework is suspended for lifting a pile.

12. A device as claimed in claim 11 in which i. means (h) include tubular means which telescopically receive leg means (i), and j. the tubular means and the associated leg means extend parallel to the lower sides of the triangle formed by the framework in cross section so that with the leg means extended, the sides of the triangle and the legs form an X.

13. A device as claimed in claim 2 including i. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

14. A device as claimed in claim 3 in which j. means (e) comprise a pivoted connection means at each of two points along the length of the framework, each pivoted connection means being intermediate one end of the framework and the center of the framework, k. each pivoted connection means comprising a tubular member rotatably supported by and encasing a transversely extending bracing member.

15. A device as claimed in claim 3 including j. leg means arranged along the length of the framework and extending below the electromagnetic means when the framework is resting on the ground, and k. means associated with the leg means for retraction of the leg means above the electromagnetic means when the framework is suspended for lifting a pile.

16. A device as claimed in claim 15 in which l. means (k) include tubular means which telescopically receive leg means (j), m. the framework is triangular in cross section with horizontal bracing members extending between two apices and the third apex is disposed below the other two, and n. the tubular means and the associated leg means extend parallel to the lower sides of the triangle formed by the framework in cross section so that with the leg means extended, the sides of the triangle and the legs form an X.

17. A device as claimed in claim 3 including j. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

18. A device as claimed in claim 3 including j. a safety chain having one end connected to the framework at a point intermediate the ends thereof and the other end free, the length of the chain being such as to permit the chain to be passed under and around a pile held by electromagnetic means, and k. fastening means associated with the framework to receive and hold the free end of the chain passing under and around the pile.

19. A device as claimed in claim 4 including i. leg means arranged along the length of the framework and extending below the electromagnetic means when the framework is resting on the ground, and j. means associated with the leg means for retraction of the leg means above the electromagnetic means when the framework is suspended for lifting a pile.

20. A device as claimed in claim 19 in which k. means (j) include tubular means which telescopically receive leg means (i)

l. the framework is triangular in cross section with horizontal bracing members extending between two apices and the third apex is disposed below the other two, and m. the tubular means and the associated leg means extend parallel to the lower sides of the triangle formed by the framework in cross section so that with the leg means extended, the sides of the triangle and the legs form an X.

21. A device as claimed in claim 4 including i. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

22. A device as claimed in claim 5 including i. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

23. A device as claimed in claim 5 including i. a safety chain having one end connection to the framework at a point intermediate the ends thereof and the other end free, the length of the chain being such as to permit the chain to be passed under and around a pile held by electromagnetic means, and j. fastening means associated with the framework to receive and hold the free end of the chain passing under and around the pile.

24. A device as claimed in claim 7 including l. flexible restraining means connecting the electromagnetic means and the framework on the side of the electromagnetic means toward the suspension end of the framework, the flexible restraining means acting to permit limited movement of the electromagnetic means in a direction along the length of the framework but restraining the electromagnetic means against extreme movement in a direction along the length of the framework and away from the suspension end.

25. A device as claimed in claim 7 including l. a safety chain having one end connected to the framework at a point intermediate the ends thereof and the other end free, the length of the chain being such as to permit the chain to be passed under and around a pile held by electromagnetic means, and m. fastening means associated with the framework to receive and hold the free end of the chain passing under and around the pile.

* * * * *